US010798476B2

(12) United States Patent
Döner

(10) Patent No.: US 10,798,476 B2
(45) Date of Patent: Oct. 6, 2020

(54) SLIDABLE MICROPHONE INSIDE A PORTABLE DEVICE

(71) Applicant: Vestel Elektronik Sanayi ve Ticaret A.S., Manisa (TR)

(72) Inventor: Cagdas Döner, Manisa (TR)

(73) Assignee: Vestel Elektronik Sanayi Ve Ticaret A.S., Manisa (TR)

( * ) Notice: Subject to any disclaimer, the term of this patent is extended or adjusted under 35 U.S.C. 154(b) by 0 days.

(21) Appl. No.: 16/263,187

(22) Filed: Jan. 31, 2019

(65) Prior Publication Data

US 2019/0238962 A1 Aug. 1, 2019

(30) Foreign Application Priority Data

Jan. 31, 2018 (EP) ..... 18154324

(51) Int. Cl.
*H04R 1/08* (2006.01)

(52) U.S. Cl.
CPC ..... *H04R 1/083* (2013.01); *H04R 2410/07* (2013.01); *H04R 2499/11* (2013.01)

(58) Field of Classification Search
CPC H04R 2410/07; H04R 1/083; H04R 2499/11; H04M 1/62; H04M 1/6091
See application file for complete search history.

(56) References Cited

U.S. PATENT DOCUMENTS

2003/0194103 A1 10/2003 Kakinuma
2014/0140558 A1* 5/2014 Kwong ..... H04R 3/007 381/345

FOREIGN PATENT DOCUMENTS

DE 20 2005 019795 U1 2/2006
DE 202005019795 U1 * 2/2006 ..... H04M 1/6091
EP 2242288 A1 10/2010
JP 2007 235316 A 9/2007
WO 2013/108081 A1 7/2013

OTHER PUBLICATIONS

European Search Report for EP 18154324, dated Apr. 17, 2018.

* cited by examiner

*Primary Examiner* — Sunita Joshi
(74) *Attorney, Agent, or Firm* — McDonnell Boehnen Hulbert & Berghoff LLP

(57) ABSTRACT

Disclosed herein are portable devices and methods for their use. A portable device, in particular a mobile phone or smart watch, which includes at least a main body that includes a screen for outputting visual information, an acoustic output means for outputting acoustic information, in particular a speaker, a processor unit for operating the portable device, a communication means for transmitting data and/or signals, in particular wirelessly, to another device, in particular a further portable device or a server device, an electric energy source for powering the portable device, and a sensor means for detecting at least one effect subjected onto the portable device; and a microphone unit for receiving acoustic waves, wherein the microphone unit includes a microphone, a transfer unit for positioning the microphone between two end-positions and an actuator for moving the microphone between the end-positions, wherein the processor unit operates the actuator in dependency of data or signals provided by the sensor means.

7 Claims, 1 Drawing Sheet

SLIDABLE MICROPHONE INSIDE A PORTABLE DEVICE

CROSS REFERENCE

This application claims priority to European patent application serial number 18154324.0 filed Jan. 31, 2018, incorporated by reference herein in its entirety.

TECHNICAL FIELD

The present invention refers to a portable device according to claim 1 and a method according to claim 12 for operating the portable device.

BACKGROUND

Mobile phone microphones are mostly located at the bottom of the device. In a windy day, unfortunately this microphone gets affected by wind noise and people cannot get each other on the phone. Because the microphone position is fixed, users need to change their location and hide or turn back to the wind.

Systems are known for excluding wind noise from detected or recorded speech by applying sound processing and frequency division techniques.

WO 2013/108081 A1 relates to a method for wind noise attenuation in microphones by controlled leakage. A housing encloses one or more parts of the microphone system, and a leakage aperture with an adjustable width is provided between the housing and the atmosphere. The width of the leakage aperture determines a cutoff frequency for a high pass filter associated with the microphone system. The width of the leakage aperture may be increased, thereby resulting in a higher cutoff frequency for the high pass filter. In embodiments where the low frequency signals (e.g., noise signals) are determined to be greater than a predetermined threshold level, the system may automatically move the leakage aperture, which is located along a side or surface of the microphone housing. A hardware-implemented sensor may directly measure at least one of the noise level associated with sound waves received at the membrane or the general noise level (e.g., wind noise level) associated with the environment in which the microphone system is being operated.

US 2003/0194103 A1 relates to a microphone apparatus with an adjusting mechanism that prevents wind noise generated at a sound absorbing hole from perceptively inputted in the structure having a microphone built-in at the back of a panel with a sound absorbing hole. A sound box is structured between a sound absorbing hole of a panel and a sound perceptible portion of a microphone, and a movable piece that slidably moves in the sound box is formed. A screw rod is annexed to the movable piece, and a disk screwed with the screw rod is restricted and interposed between a tubular portion, serving as an outer frame of the sound box, and a support portion formed at the lower portion. A part of the disk is exposed to the front surface side from a slit of the panel, and the disk is rotated to move the movable piece, thereby changing a resonant frequency of a ventilation space of the sound box and a ventilation cross.

EP 2 242 288 A1 relates to a microphone which comprises a movable diaphragm and a back electrode. The mechanical relationship between the back electrode and the diaphragm is adjustable to control the cut-off frequency of the microphone. This enables the microphone to be adapted to different noise environments. The diaphragm and the back electrode are spaced by a spacer arrangement. The back electrode preferably comprises an array of vent openings. These are used to enable free movement of the diaphragm. The diaphragm may also comprise a plurality of openings, and it is the alignment or misalignment of openings that can then be used to tune the acoustic properties of the microphone.

Prior systems are focused on excluding the wind noise from the speech with applying sound processing and frequency division techniques. Some of the prior embodiments modified microphone holes with additional equipment but without wind check for mobile phones.

However, all of the before mentioned prior art documents provide embodiments which do not provide a good isolation of the wind noise.

OBJECT OF THE INVENTION

Accordingly, there is a need for an improved solution. Thus, it is the object of the present invention to provide a portable device and a method for operating such a device, wherein the device and the method should provide an alternative and/or better solution.

SUMMARY OF THE INVENTION

The present invention provides a portable device with the features of claim 1. Thus, the portable device, in particularly a mobile phone or smart watch, according to the present invention preferably comprises at least a main body, wherein the main body preferably comprises a screen for outputting visual information, an acoustic output means for outputting acoustic information, in particularly a speaker, a processor unit for operating the portable device, a communication means for transmitting data and/or signals, in particularly wirelessly, to another device, in particularly a further portable device or a server device, an electric energy source for powering the portable device and/or a sensor means for detecting at least one effect subjected onto the portable device, and/or a microphone unit for receiving acoustic waves, wherein the microphone unit comprises a microphone and/or a transfer unit for positioning the microphone between two end-positions and an actuator for moving the microphone between the end-positions, wherein the processor unit operates the actuator in dependency of data or signals provided by the sensor means.

This solution is beneficial since the hardware is modified in dependence of the detected situation, in particularly wind noise. This solution can be combined with software based modifications or modulations of detected respectively recorded sounds or sound waves or noise. Thus, the above mentioned prior art is incorporated herein by reference and can be combined with the present solution.

The present invention can be described as floating (moving) microphone system, in particular as floating or moving microphone system or microphone unit of a portable device, in particularly a mobile phone, smart watch or tablet pc, to resolve the dis-communication issue during windy or stormy days.

Further embodiments of the present invention are subject of the further sub-claims and of the following description.

According to a preferred embodiment of the present invention the transfer unit extends from a first surface of the portable device to a second surface of the portable device, wherein the first surface is preferably a front side of the portable device and wherein the second surface is preferably a backside of the portable device. This embodiment is beneficial since in case wind is present on one side of the device air flow around the other side of the device is less. Thus, the microphone can be positioned to the side which has the lowest turbulences respectively the lowest effects on the noise generation.

The transfer unit extends according to a further preferred embodiment of the present invention preferably straight between the first surface and the second surface, wherein the transfer unit has at least sectionally or in most sections a cylindrical shape, wherein the sensor means is preferably arranged in the area of the microphone unit. In the area of the transfer unit preferably means, that the sensor is preferably arranged in a distance to the sensor or to the transfer unit of less than 100 mm distance or of less than 70 mm distance or of less than 50 mm distance or of less than 30 mm distance or of less than 10 mm distance or of less than 5 mm distance or of less than 1 mm distance. It is preferably possible that the sensor is part of the microphone or arranged as part of the transfer unit.

Thus, there is a moving/sliding mechanism for moving respectively sliding the microphone inside the portable device, in particular along a channel inside the portable device. This channel is preferably located in the bottom side of the portable device. The channel preferably has a cylindrical shape or is a cylinder. The channel preferably provides the moving capability for the microphone. The cylinder preferably has not a big radius, in particularly a little larger, that means up to 5% or up to 10% or up to 20% or up to 30% or up to 50% or up to 75% or up to 100% or up to 200% larger than the normal microphone holes, which preferably have a diameter of up to or exactly or below 0.01 mm or of up to or exactly or below 0.1 mm or of up to or exactly or below 0.5 mm or of up to or exactly or below 1 mm or of up to or exactly or below 2 mm but has the capability of moving the microphone towards and the backwards of the mobile phone. The channel preferably extends in particularly fully between front side and the back of the portable device, in particulars represents a line thru front side and the back of the phone or tablet pc or smart watch. However, it is possible that just one or at least one microphone hole is present in the first surface and/or on the second surface, in particularly in the direction of the transfer unit or channel or cylinder.

The sensor means comprises according to a further preferred embodiment of the present invention one or multiple wind detector elements. One or at least one sensor or wind detector element is preferably arranged on the first side of the portable device and one or at least one sensor or wind detector element is preferably arranged on the second side of the portable device. Preferably provide multiple sensors or wind detector devices, in particularly at least one from each side data to the processor unit, in particularly CPU. This embodiment is beneficial since a very precise monitoring of the present noise respectively wind situation is possible. Thus, the position of the microphone can be adapted constantly or in predefined intervals to the situation detected by the sensors respectively wind detector devices.

The wind detector element or wind detector device detects according to a further preferred embodiment of the present invention pressure or pressure changes caused by air flow and/or noise or noise changes caused by air flow. A wind sensor is e.g. known from https://vimeo.com/62769770. This embodiment is beneficial since such sensors are very reliable and provide precise data.

In case of noise detection the microphone can be understood as sensor means. However, it is also possible that another or further sensor means are provided for capturing acoustic waves caused by air flow. The processor unit preferably analyzes data or signals representing the air flow sound. Thus, in case the processor unit determines the presence or air flow the microphone of the microphone unit is repositioned respectively re-oriented respectively moved to another position. The processor unit preferably has access to a data base, wherein the data base preferably provides data representing sound patterns, wherein the sound patterns represent sound or noise generated by air flow, in particularly wind.

According to a further preferred embodiment of the present invention the processor unit operates the actuator in case the sensor means provides data or signals which are above a predefined threshold, in particularly for a predefined time. The threshold is hereby preferably a pressure value and/or a noise value. It is preferably checked or analyzed on which side of the device more wind respectively more wind noise is present. This embodiment is beneficial since even in stormy situations the best possible position of the microphone can be found respectively the microphone can be positioned in the position which is exposed to the fewest wind and/or wind noise and/or wind pressure, in particular wind pressure changes.

The actuator is according to a further preferred embodiment of the present invention a step motor or a servo motor or a piezo electric actuator. The actuator causes preferably pressure differences inside the transfer unit, wherein the microphone moves in dependency of the pressure differences. It is alternatively or additionally possible that the actuator and/or the microphone comprises an electromagnetic element, wherein the microphone moves in dependency of an operation of the electromagnetic element. The microphone is preferably coupled with a guiding structure that limits the degree of freedom of the microphone to one direction or to two directions, in particular a longitudinal direction and/or a rotatory direction, in particularly around a center axis of the microphone.

The microphone is according to further preferred embodiment of the present invention positionable in a default position in case the microphone is not operated. The sensor means is preferably operated in case an incoming call is detected or in case an incoming call is started or in case an outgoing call is started. In particularly in case of incoming calls, the position of the microphone is modified before the call is established. This embodiment is beneficial since wind noise can be reduced directly from the beginning of the call.

The cylindrical unit has according to a further preferred embodiment of the present invention a first opening on the first surface and a second opening on the second surface. Referring to FIGS. 1(*a*) and 1(*c*), the first opening 266 can preferably be closed by a first closing element 270 and wherein the second opening 268 can preferably be closed by a second closing element 272, wherein the first closing element 270 closes the first opening 266 in case the microphone is positioned closer to the second opening 268 than to the first opening 266 or wherein the second closing element 272 closes the second opening 268 in case the microphone 210 is positioned closer to the first opening 266 than to the second opening 268. The closing elements or actuators for moving the closing elements can be operated by the processing unit. This embodiment is beneficial since sound or noises caused by air passing the opening can be reduced or avoided.

Referring to FIG. 1(*a*) and FIG. 1(*c*), the cylindrical unit has according to a further preferred embodiment of the present invention a first opening on the first surface and a second opening on the second surface, wherein the first opening is preferably covered by a membrane 280 and wherein the second opening is covered by a membrane 282. The membrane can be a textile membrane like Gore-Tex or any other membrane that reduces air flow through or into the opening.

The before mentioned object is also solved by a method according to claim 12 for receiving acoustic waves with a portable device, in particularly a mobile phone or smart watch or tablet pc. The method preferably comprises at least the steps: Providing the portable device, wherein the portable device comprises a main body, wherein the main body comprises a screen for outputting visual information, an acoustic output means for outputting acoustic information, in particularly a speaker, a processor unit for operating the portable device, a communication means for transmitting data and/or signals, in particularly wirelessly, to another device, an electric energy source for powering the portable device and/or a sensor means for detecting at least one effect subjected onto the portable device, and/or a microphone unit for receiving acoustic waves, wherein the microphone unit comprises a microphone, a transfer unit for positioning the microphone between two end-positions and/or an actuator for moving the microphone between the end-positions, detecting wind, in particularly detecting air pressure or acoustic waves, by means of the sensor means, generating data or signals representing the detected wind, in particularly pressure or acoustic waves, transferring the data or signals to the processor unit, analyzing the data or signals by means of the processor unit, operating the actuator in dependency of the analyzed data or signals, moving the microphone inside the transfer unit by means of the actuator.

The processor unit or CPU is at least indirectly connected, in particularly via wire or printed circuit board to the sensor means, screen, microphone unit and/or acoustic output means.

BRIEF DESCRIPTION OF THE DRAWINGS

For a more complete understanding of the present invention and advantages thereof, reference is now made to the following description taken in conjunction with the accompanying drawings. The invention is explained in more detail below using an exemplary embodiment which is specified in the schematic figures of the drawings, in which.

DETAILED DESCRIPTION OF THE DRAWINGS

Figures 1A, 1B, 1C:
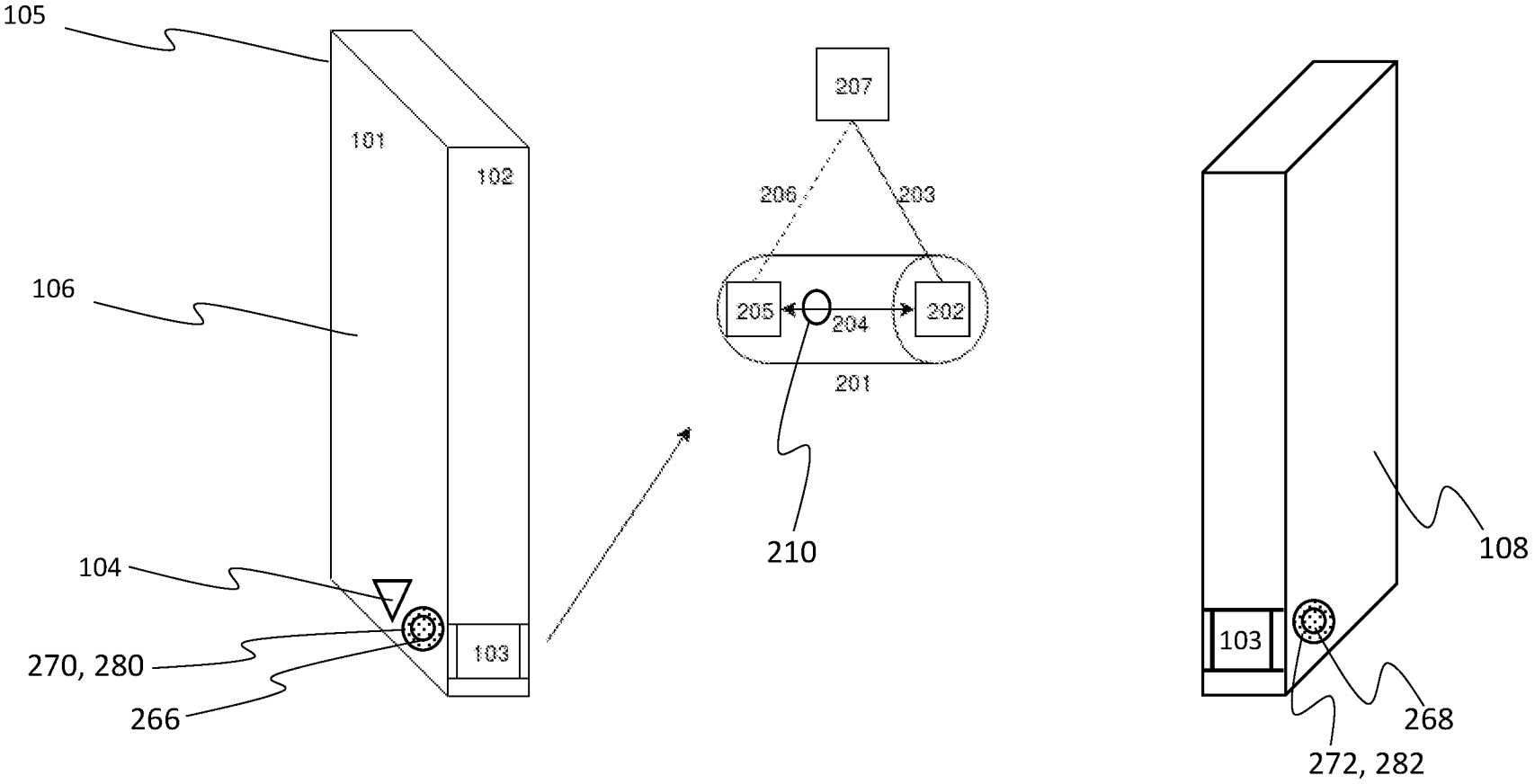
FIG. 1*a* shows a portable device.
FIG. 1*b* shows a transfer unit for moving a microphone inside the portable device.
FIG. 1*c* shows a backside of a portable device.

FIG. 1 shows a portable device 101, in particularly a mobile phone. 102 indicates the side or depth dimension of the portable device 101, in particularly mobile phone. A transfer unit 103 preferably having a cylinder channel is mounted inside the portable device 101 or is attached to the portable device. The transfer unit 103 preferably extends between a first surface and a second surface of the portable device or connects a first surface and a second surface of the portable device. The first surface and the second surface are preferably spaced apart in direction 102.

FIG. 1*b* shows an example of the transfer unit, wherein the transfer unit preferably has a structure or forms a structure which is similar or identical as a cylinder. Thus, reference number 201 preferably refers to a structure of the cylinder. 202 indicates a default location for the microphone 210 of the portable device, in particularly mobile phone. 203 is the default wirings to feed data to microphone 210 from the main processor respectively processor unit 207. The microphone 210 has the ability of moving, in particularly sliding, in the direction of 204 and therefore from a location close to the front side respectively first surface to a backside 108 respectively the second surface. So, 205 indicates a position of the microphone 210 arranged in a further position different from the default position, thus the microphone is moved or slided from the default position to the indicated position. Also reference number 206 indicates the slided wiring/cabling equipment within the new position in 205.

It is alternatively possible that the transfer unit, in particular channel or cylinder 201, provides a signal, energy and/or data connection to the microphone 210. Such a connection is preferably constantly or at least in specific positions established. Thus, the microphone transfers signals and/or data to the channel or cylinder, wherein said signals or data is further transferred to the processor unit 207. This embodiment is beneficial since less moving parts are required and therefore less wear and/or better reliability results.

The microphone 210 basically can be moved by an actuator in particularly a basic step motor device. The actuator is preferably powered and/or controlled by main processor 207. Thus, the microphone 210 is able to move in direction 204 due to an actuation of the actuator. Additionally or alternatively, moving capability can be supported in cylinder with magnetic effect or pressure changes. For magnetic activation, main processor may induct the electromagnet powered microphone to make it moved.

Reference number 104 indicates a sensor means. The sensor means 104 preferably comprises multiple wind detector elements, wherein a first wind detector element is arranged on the first surface or as part of the first surface or closer to the first surface than to the second surface and a second wind detector element is arranged on the second surface or as part of the second surface or closer to the second surface than to the first surface. The first surface is hereby a front surface and the second surface is hereby a back surface. The front surface and back surface are preferably arranged parallel with respect to each other.

Thus, the present invention provides a portable device 101, in particularly a mobile phone or smart watch. The portable device 101 preferably comprises at least a main body, wherein the main body 105 comprises a screen for outputting visual information, an acoustic output means for outputting acoustic information, in particularly a speaker, a processor unit 207 for operating the portable device, a communication means for transmitting data and/or signals, in particularly wirelessly, to another device, in particularly a further portable device or a server device, an electric energy source for powering the portable device and a sensor means 104 for detecting at least one effect subjected onto the portable device 101, and a microphone unit for receiving acoustic waves, wherein the microphone unit comprises a microphone 210, a transfer unit 103 for positioning the microphone between two end-positions and an actuator for moving the microphone between the end-positions, wherein the processor unit 207 operates the actuator in dependency of data or signals provided by the sensor means.

Although since one specific embodiment have been illustrated and described herein, it will be appreciated by those of ordinary skill in the art that a variety of alternate and/or equivalent implementations exist. It should be appreciated that the exemplary embodiment is only an example, and is not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

LIST OF REFERENCE SIGNS

101 portable device
102 side dimension/depth
103 transfer unit
104 sensor
105 main body
106 front side
108 backside
201 structure of cylinder
202 default location
203 default wiring
204 sliding direction
205 further position/location
206 slided/moved wiring/cabeling
207 main processor/processor unit
210 microphone
266 first opening
268 second opening
270 first closing element
272 second closing element
280 membrane covering for first opening
282 membrane covering for second opening

The invention claimed is:

1. Portable device, in particular a mobile phone or smart watch, at least comprising a main body, wherein the main body comprises a screen for outputting visual information, an acoustic output means for outputting acoustic information, in particular a speaker, a processor unit for operating the portable device, a communication means for transmitting data and/or signals, in particular wirelessly, to another device, in particular a further portable device or a server device, an electric energy source for powering the portable device and a sensor means for detecting at least one effect subjected onto the portable device, and a microphone unit for receiving acoustic waves, wherein the microphone unit comprises a microphone, a transfer unit for positioning the microphone between two end-positions and an actuator for moving the microphone between the end-positions, wherein the processor unit operates the actuator in dependency of data or signals provided by the sensor means, and wherein the transfer unit extends from a first surface of the portable device to a second surface of the portable device, the first surface is a front side of the portable device and wherein the second surface is preferably a backside of the portable device, the transfer unit extends straight between the first surface and the second surface, and the transfer unit has at least sectionally or in most sections a cylindrical shape, and the sensor means is arranged close by the microphone unit, wherein the sensor means comprises one or multiple wind detector elements, and the sensor means comprises multiple wind detector elements, wherein a first wind detector element is arranged on the first surface or as part of the first surface or closer to the first surface than to the second surface and a second wind detector element is arranged on the second surface or as part of the second surface or closer to the second surface than to the first surface.

2. Portable device according to claim 1, characterized in that the wind detector element detects pressure or pressure changes caused by air flow and/or noise or noise changes caused by air flow.

3. Portable device according to claim 2, characterized in that the processor unit operates the actuator in case the sensor means provides data or signals which are above a predefined threshold, in particularly for a predefined time.

4. Portable device according to claim 3, characterized in that the actuator is a step motor or a servo motor or a piezo electric actuator and/or the actuator causes pressure differences inside the transfer unit, wherein the microphone moves in dependency of the pressure differences and/or the actuator and/or the microphone comprises an electromagnetic element, wherein the microphone moves in dependency of an operation of the electromagnetic element.

5. Portable device according to claim 4, characterized in that the microphone is positionable in a default position in case the microphone is not operated, and the sensor means is operated in case an incoming call is detected or in case an outgoing call is started, wherein the position of the microphone is modified before the call is established.

6. Portable device, in particular a mobile phone or smart watch, at least comprising a main body, wherein the main body comprises a screen for outputting visual information, an acoustic output means for outputting acoustic information, in particular a speaker, a processor unit for operating the portable device, a communication means for transmitting data and/or signals, in particular wirelessly, to another device, in particular a further portable device or a server device, an electric energy source for powering the portable device and a sensor means for detecting at least one effect subjected onto the portable device, and a microphone unit for receiving acoustic waves, wherein the microphone unit comprises a microphone, a transfer unit for positioning the microphone between two end-positions and an actuator for moving the microphone between the end-positions, wherein the processor unit operates the actuator in dependency of data or signals provided by the sensor means, wherein a cylindrical unit has a first opening on the first surface and a second opening on the second surface, wherein the first opening can be closed by a first closing element and wherein the second opening can be closed by a second closing element, wherein the first closing element closes the first opening in case the microphone is positioned closer to the second opening than to the first opening or wherein the second closing element closes the second opening in case the microphone is positioned closer to the first opening than to the second opening.

7. Portable device, in particular a mobile phone or smart watch, at least comprising a main body, wherein the main body comprises a screen for outputting visual information, an acoustic output means for outputting acoustic information, in particular a speaker, a processor unit for operating the portable device, a communication means for transmitting data and/or signals, in particular wirelessly, to another device, in particular a further portable device or a server device, an electric energy source for powering the portable device and a sensor means for detecting at least one effect subjected onto the portable device, and a microphone unit for receiving acoustic waves, wherein the microphone unit comprises a microphone, a transfer unit for positioning the microphone between two end-positions and an actuator for moving the microphone between the end-positions, wherein the processor unit operates the actuator in dependency of data or signals provided by the sensor means, wherein a cylindrical unit has a first opening on the first surface and a second opening on the second surface, wherein the first opening is covered by a membrane and wherein the second opening is covered by a membrane.

* * * * *